US007451572B1

(12) United States Patent
Inzeo et al.

(10) Patent No.: US 7,451,572 B1
(45) **Date of Patent: *Nov. 18, 2008**

(54) ROOF FASCIA WITH EXTENSION CLEAT

(75) Inventors: Joseph A. Inzeo, West Allis, WI (US); Scott A. Kittilstad, Waukesha, WI (US)

(73) Assignee: Metal-Era, Inc., Waukesha, WI (US)

( * ) Notice: Subject to any disclaimer, the term of this patent is extended or adjusted under 35 U.S.C. 154(b) by 353 days.

This patent is subject to a terminal disclaimer.

(21) Appl. No.: 11/146,675

(22) Filed: Jun. 7, 2005

Related U.S. Application Data

(63) Continuation-in-part of application No. 10/277,552, filed on Oct. 22, 2002, now Pat. No. 6,912,814.

(51) Int. Cl.
*E04D 13/15* (2006.01)
*E04D 3/38* (2006.01)

(52) U.S. Cl. ..... 52/60; 52/58; 52/97; 52/300

(58) Field of Classification Search ..... 52/60, 52/58, 97, 96, 94, 300, 61
See application file for complete search history.

(56) References Cited

U.S. PATENT DOCUMENTS

| | | | | | |
|---|---|---|---|---|---|
| 3,834,104 | A | * | 9/1974 | Dunn et al. | 52/376 |
| 4,037,372 | A | * | 7/1977 | Patry | 52/96 |
| 4,641,476 | A | * | 2/1987 | Webb et al. | 52/60 |
| 4,707,954 | A | * | 11/1987 | Butzen | 52/96 |
| 4,709,518 | A | * | 12/1987 | Lane | 52/94 |
| 4,780,997 | A | * | 11/1988 | Taylor et al. | 52/96 |
| 4,780,999 | A | * | 11/1988 | Webb et al. | 52/96 |
| 4,800,689 | A | * | 1/1989 | Lane | 52/60 |
| 5,189,853 | A | * | 3/1993 | Braine et al. | 52/96 |
| 5,619,827 | A | * | 4/1997 | Church | 52/60 |
| 5,927,023 | A | * | 7/1999 | Kittilstad | 52/60 |
| 5,950,375 | A | | 9/1999 | Zaccagni | 52/94 |
| 6,026,616 | A | | 2/2000 | Gibson | 52/95 |
| 6,035,587 | A | | 3/2000 | Dressler | 52/97 |

(Continued)

OTHER PUBLICATIONS

Anchor-Tite Standard Joint Detail, Metal-Era Roof Edge Systems Drawing #10111A013, Aug. 8, 2001.

(Continued)

*Primary Examiner*—Robert J Canfield
*Assistant Examiner*—Jessie Fonseca
(74) *Attorney, Agent, or Firm*—Donald J. Ersler

(57) ABSTRACT

A roof edging system includes an anchor bar, an extension cleat attachable to the anchor bar, and a cover plate applied over the anchor bar and extension cleat. The anchor bar may be of a generally uniform size and shape and the extension cleat may be of varying sizes. The anchor bar and extension cleat are secured to the exterior of the building using fasteners inserted through a number of apertures in each member. The engagement of the anchor bar with the roof provides a waterproof seal between a roofing membrane placed on the roof and the anchor bar. The extension cleat provides a means to vary the overall length of the assembly. A durable cover plate may then be attached over the anchor bar and extension cleat to provide an aesthetically pleasing appearance to the periphery of the roof of the building.

12 Claims, 9 Drawing Sheets

U.S. PATENT DOCUMENTS

| | | | | |
|---|---|---|---|---|
| 6,088,992 | A | 7/2000 | Nunley | 52/783.19 |
| 6,138,418 | A | 10/2000 | Dyer et al. | 52/94 |
| 6,167,660 | B1 * | 1/2001 | Sama | 52/58 |
| 6,212,829 | B1 | 4/2001 | Webb et al. | 52/96 |
| 6,216,408 | B1 | 4/2001 | Davidson | 52/300 |
| 6,237,293 | B1 | 5/2001 | Gembala | 52/302.6 |
| 6,360,504 | B1 | 3/2002 | Webb et al. | 52/300 |
| 6,378,256 | B1 | 4/2002 | Gembala | 52/301 |
| 6,578,322 | B2 * | 6/2003 | Kintop | 52/96 |
| 6,606,828 | B1 * | 8/2003 | Lin et al. | 52/58 |

OTHER PUBLICATIONS

Anchor-Tite Fascia—Standard Version, Metal-Era Roof Edge Systems Drawing #10116A000-10116A002, Apr. 18, 2002.
Anchor-Tite Extender Fascia—Std. AEF-850, Metal-Era Roof Edge Systems Drawing #12116A001-12116A004, May 29, 2002.
Custom Anchor-Tite Extender Fascia Std. AEF-X, Metal-Era Roof Edge Systems Drawing #12116A000, May 13, 2002.
Anchor-Tite Fascia—B.U.R./Modified Version, Metal-Era Roof Edge Systems Drawing #10116A001, May 9, 2002.
Anchor-Tite Fascia—B.U.R./Modified, Metal-Era Roof Edge Systems Drawing #11116A003-11116A004, Jun. 1, 2002.
Anchor-Tite Fascia—B.U.R./Modified, Metal-Era Roof Edge Systems Drawing #11113A005-11113A006, Jun. 1, 2002.
Component List A-T Fascia—B.U.R. Modified Version, Metal-Era Roof Edge Systems, Drawing #11116A007, May 10, 2002.
Anchor-Tite Extender Fascia Modified. AEFM-850, Metal-Era Roof Edge Systems Drawing #12116A006-12116A009, May 29, 2002.
Custom Anchor-Tite Extender Fascia Modified. AEFM-X, Metal-Era Roof Edge Systems Drawing#12116A005, May 13, 2002.
Base Bar specification sheet/scale drawing, Indalex Aluminum Solutions, Apr. 4, 2002.
Base Bar With Modified Flange specification sheet/scale drawing, Indalex Aluminum Solutions, Apr. 4, 2002.
Roof Edge Systems catalog, Metal-Era Roof Edge Systems, Mar. 2001.

* cited by examiner

ROOF FASCIA WITH EXTENSION CLEAT

RELATED APPLICATIONS

This application is a continuation-in-part of application Ser. No. 10/277,552 filed on Oct. 22, 2002, which has been allowed and patented as U.S. Pat. No. 6,912,814.

BACKGROUND OF THE INVENTION

1. Field of the Invention

The present invention relates to roof edging and waterproofing systems, and more specifically to a roof edging system capable of being adapted for use with facings of various sizes to provide the desired appearance for roof edges of buildings.

2. Background of the Invention

Many types of buildings have flat roofs with exposed roof edges that must be sealed in order to prevent water from leaking into the interior of the building. The roofs on buildings of this type include fully adhered or mechanically attached single ply roofs and built-up or modified roof systems, among others.

In order to effectively seal the roofs of these buildings, many different roof edging systems, such as fascias and copings, have been developed which cooperate with a roofing membrane placed over the roof to prevent water from entering a building between the membrane and the remainder of the building.

Most of the prior art edging systems comprise a base plate fastened over a peripheral edge of the roofing membrane in order to secure and seal the roofing membrane between the base plate and the building. In order to provide a more aesthetically pleasing appearance to the exterior of the building, the base plates are also configured to have a cover plate secured to the side of the base plate opposite the building. The cover plate essentially conceals the base plate and the edge of the roof to provide the desired appearance to the building. An example of a roof edging system of this type is illustrated in Kittilstad U.S. Pat. No. 5,927,023, which is herein incorporated by reference.

However, with roof edging or fascia systems of this type, the size and shape of the cover plate that is attached to the base plate is determined solely by the size of the base plate, i.e., a small base plate can only be used with a small cover plate. Therefore, if a particular edging system is used for a building, the size of the cover plate utilized with the system has to conform in size to the size of the base plate and cannot be varied in size, often resulting in a situation where the edging system provides an appearance to the roof of the building which does not conform to the remainder of the building. Also, based on the configuration of the cover plates and the particular way in which the cover plates are secured to the base plates, the cover plates have to be formed to be relatively thin such that the cover plates can be flexed more easily when engaging the cover plates with the base plates. The thinness of the material forming the cover plates often times results in damage being done to the cover plates both during the installation of the cover plates and during the exposure of the cover plates to the elements.

Therefore, it is desirable to develop a roof edging system that is capable of being varied in size to adapt to and engage cover plates of a desired size and shape, and which enables thicker cover plates to be utilized with the edging system.

SUMMARY OF THE INVENTION

It is an object of the present invention to provide a roof edging system which includes an anchor bar or base plate, and further includes an extension cleat attachable to the anchor bar to thereby extend the overall length of the edging system as necessary.

It is another object of the present invention to provide a roof edging system in which the shape of the anchor bar and extension cleat allow a thicker cover plate to be attached to the anchor bar and the extension cleat to provide a more durable edging system.

It is still another object of the present invention to provide a roof edging system including an anchor bar which, separate from being connected to the extension cleat, can be adapted for use in a conventional fascia system or in a coping system.

It is still another object of the present invention to provide a roof edging system including resilient spacers and splice plates that can be incorporated as needed to join adjacent anchor bars and cover plates to provide a continuous appearance to the edging system.

It is still a further object of the present invention to provide a roof edging system in which the anchor bar, extension cleat and cover plate are easily assembled with one another.

The present invention is a roof edging system including an anchor bar having a locking flange disposed on a lower end of the anchor bar. The locking flange is attachable to one end of an extension cleat whose length can be varied as desired in order to provide the necessary overall width for the edging system. Opposite the locking flange, the extension cleat includes an edge which is engageable with one end of a cover plate in order to secure the cover plate to the edging system. The cover plate is engageable with the anchor bar opposite the cleat in order to effectively and reliably hold the cover plate on the anchor bar and cleat. The extension of the overall width of the edging system by the cleat allows a larger and thicker cover plate to be used with the edging system such that the cover plate is more durable and retains its aesthetic appearance for a much longer period of time.

The anchor bar also includes a sealing flange that engages and compresses the roofing membrane onto the roof in order to provide a watertight seal between the anchor bar and the roofing membrane. The engagement of the sealing flange and the membrane can be enhanced by placing a sealant between the sealing flange and the membrane. Further, in order to provide an adequate waterproof seal around the entire periphery of the roof, adjacent anchor bars can be sealingly engaged with one another and with the roofing membrane by a number of spacers formed of a resilient material and positioned between adjacent anchor bars. The presence of the spacers does not detract from the pleasing appearance provided by the edging system due to splice plates that can be positioned over the spacers and extend between the adjacent cover plates.

Various alternative embodiments and modifications to the invention will be made apparent to one of ordinary skill in the art by the following detailed description taken together with the drawings.

BRIEF DESCRIPTION OF THE DRAWINGS

The drawings, which constitute part of the specification and include exemplary embodiments of the present invention, include the following.

DETAILED DESCRIPTION

Figure 1:
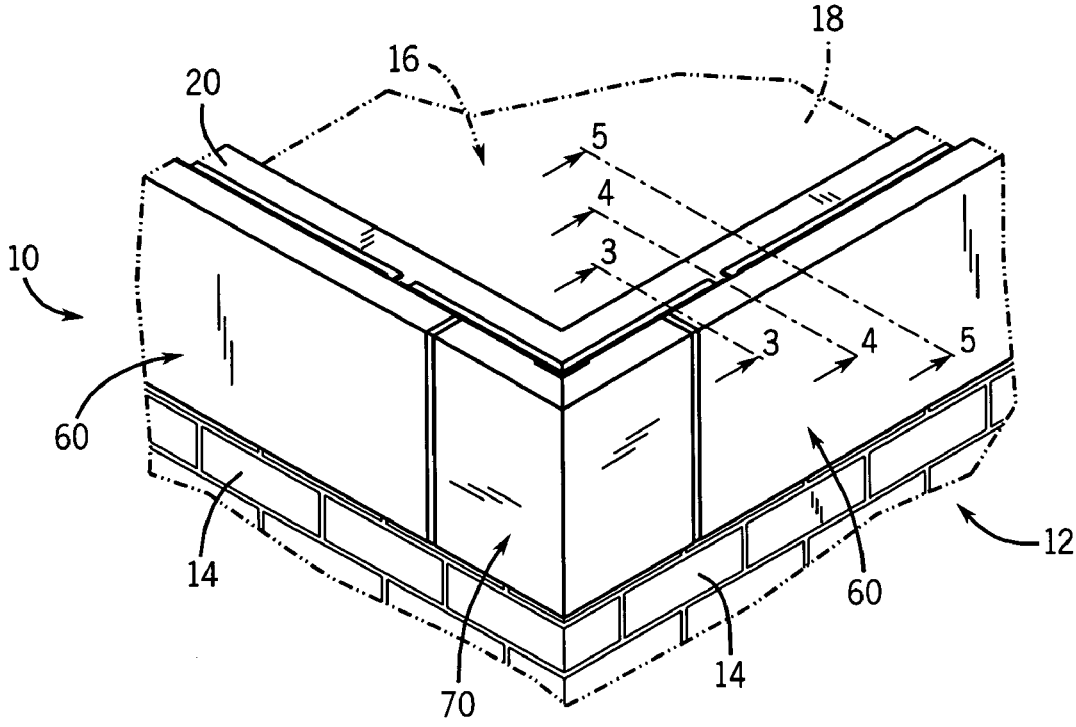
FIG. 1 is a partially broken away isometric view of a roof of a building having the roof edging assembly constructed according to the present invention attached thereto.

With reference now to the drawing figures in which like-reference numerals designate like parts throughout the disclosure, the roof edging system of the present invention is illustrated generally at 10 in FIG. 1. The system 10 is secured to a building 12 having a number of side walls 14 and a roof 16. The system 10 is designed to be secured to the building 12 at the intersection or joining of the walls 14 and the roof 16 in order to provide a more aesthetically pleasing appearance to the exterior of the building 12.

As best shown in FIGS. 2-5, in a first embodiment the system 10 is attached to the building 12 having a built up or modified roof over a roofing membrane 18 that covers the roof 16 and extends upwardly from the roof 16 over a conventional wooden nailer 20 positioned on top of each of the walls 14. The membrane 18 extends over the nailer 20 and downwardly to cover the uppermost portion of each of the walls 14 and provide a waterproof layer over the entire surface of the roof 16 of the building 12. Further, in some roof constructions, there is also a flashing strip (not shown) and/or base sheet (not shown) used in conjunction with the membrane 18.

The edging system 10 includes an anchor bar 22 formed of a rigid material, preferably metal, and most preferably aluminum. The anchor bar 22 is formed as an elongate generally rectangular member having an engagement portion 24 extending perpendicularly from one end of the anchor bar 22, a locking flange 26 extending outwardly from the anchor bar 22 opposite the engagement portion 24, and a sealing flange 28 extending perpendicularly from the anchor bar 22 parallel to the engagement portion 24 and spaced between the locking flange 26 and engagement portion 24. The engagement portion 24 is integrally formed with the anchor bar 22 and includes a longitudinal groove 30 extending the length of the engagement portion 24. The locking flange 26 is also integrally formed with the anchor bar 22 and is formed by shaping the part of the anchor bar 22 opposite the engagement portion 24 into a generally U-shaped configuration to define a longitudinal slot 32 between opposite halves of the locking flange 26.

The sealing flange 28 is also integrally formed with the anchor bar 22 similarly to the engaged portion 24 and includes a downwardly extending bead 34 disposed on the sealing flange 28 opposite the anchor bar 22. The flange 28 also preferably includes a serrated section 29 disposed on the flange 28 opposite the engagement portion 24.

To secure the bar 22 to the wall 14, the anchor bar 22 includes a number of apertures 36 extending through the anchor bar 22 and disposed between the locking flange 26 and sealing flange 28. Each of the apertures 36 is adapted to receive a fastener 38 including a washer 39, such as a clip, a nail, a wood/metal screw, or other suitable mechanical fastener which penetrates through the anchor bar 22 into the nailer 20 to secure the anchor bar 22 to the building 12. The portion 40 of the anchor bar 22 in which the apertures 36 are disposed may also be thickened to provide additional strength to the anchor bar 22 in the region where the anchor bar 22 is secured by the fasteners 38 to the building 12.

When the bar 22 is secured to the building 12, in order to provide a waterproof seal around the periphery of the roof 16 of the building 12, the anchor bar 22 is positioned over the roofing membrane 18 on the nailer 20 such that the connection of the anchor bar 22 to the nailer 20 also fixes the roofing membrane 18 over the nailer 20. However, in order to provide an enhanced waterproof seal between the roofing membrane 18 and the nailer 20 and anchor bar 22, an amount of a sealant 42 is positioned on the serrated portion 29 of the sealing flange 28 such that when the anchor bar 22 is engaged with the roofing membrane 18, the sealant 42 contacts and spreads along the portion of the membrane 18 disposed beneath the sealing flange 28. Depending on the amount of sealant 42 utilized, the sealant 42 is prevented from squeezing out of the space between the sealing flange 28 and the membrane 18 by the presence of the bead 34 on the far end of the sealing flange 28.

Figure 2:
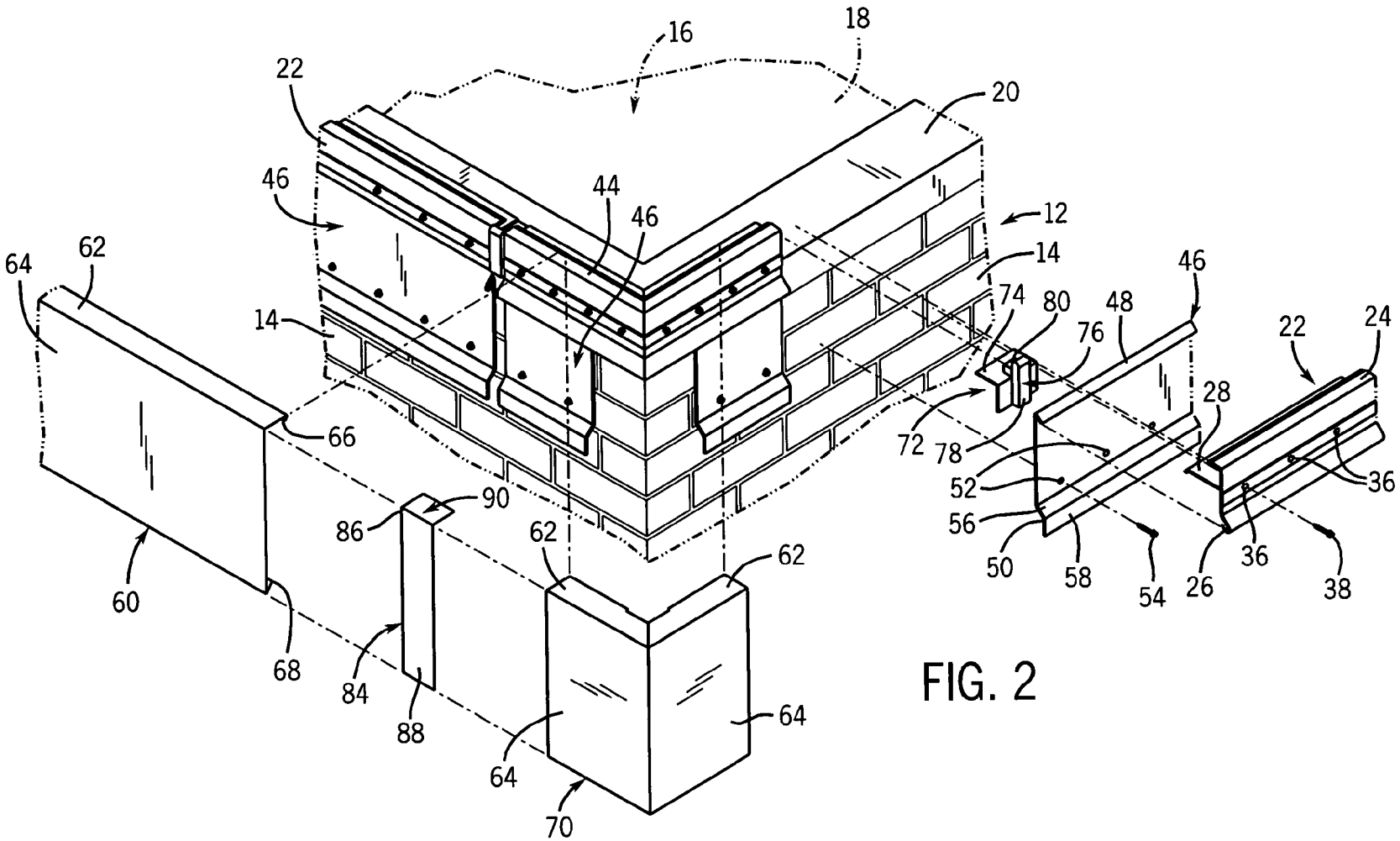
FIG. 2 is an exploded view of the roof edging assembly of FIG. 1.

The anchor bar 22 can be formed in any necessary configuration to fit the particular curvature or design of a roof 16 such that the edging system 10 can be utilized with buildings 12 having various shapes. For example, as best shown in FIG. 2, the anchor bar 22 can be formed as a straight bar, or can be bent or formed into a right angle shape in order to form an outside miter 44 for use on the corner of a building 12. Further, while not shown in the drawings, the anchor bar 22 can be formed to have an opposite right angled shape to form an inside miter, or can be curved to conform to a curved section of a roof 16 of a building 12, among other possible shapes.

Figure 3:
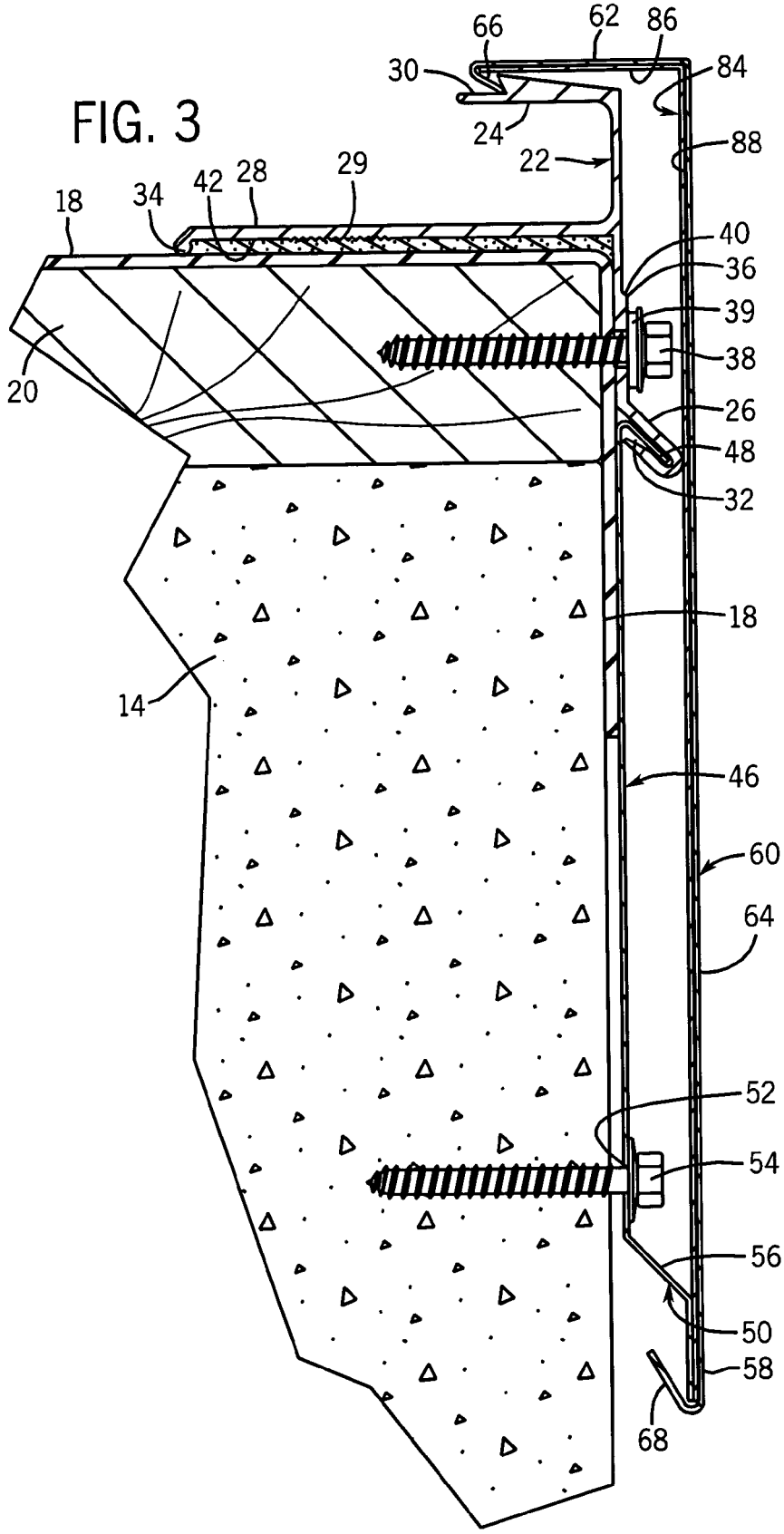
FIG. 3 is a cross-sectional view along line 3-3 of FIG. 1.

The edging system 10 also includes an extension cleat 46. The anchor cleat 46 is formed of a semi-rigid material, such as a thin metal, and includes a locking tab 48 at one end. The tab 48 extends longitudinally the entire length of the anchor cleat 46 and is shaped complimentary to the locking flange 26 on the anchor bar 22. The extension cleat 46 can be attached to the anchor bar 22 by inserting of the locking tab 48 into the locking flange 26. Preferably, the locking flange 26 is angled outwardly from the anchor bar 22 as shown in FIG. 3 such that when the locking tab 48 is inserted within the locking flange 26 and the bar 22 is secured to the wall 14, the locking tab 48 is safely secured within the locking flange 26 on the anchor bar 22.

Opposite the locking tab 48, the extension cleat 46 also includes an engagement end 50 and a number of apertures 52 spaced adjacent the securing end 50. The apertures 52 receive fasteners 54, such as screws, which, similar to the fasteners 38 for the anchor bar 22, are used to fasten the lower end of the extension cleat 46 to the walls 14 of the building 12. Because the extension cleat 46 is safely secured the to anchor bar 22, the fasteners 54 for the extension cleat 46 may be applied either concurrently during assembly of the anchor bar 22 to the roof edge, or later in the process as desired.

The securing end 50 of the extension cleat 46 is preferably formed with an angled portion 56 extending outwardly from the anchor cleat 46 immediately adjacent the apertures 52, and a flat portion 58 extending parallel to the remainder of the anchor cleat 46 from the end of the angled portion 56. The length and angle of the angled portion 56 is chosen to position the securing end 50 at a location essentially coplanar with the outermost point of the locking flange 26 to enable the remaining components of the system 10, namely the cover 60, to be secured parallel to the anchor bar 22 and extension cleat 46.

Further, the width of the extension cleat 46 between the angled portion 56 and the locking tab 48 can be varied as necessary, such that the anchor bar 22 and cleat 46 can be varied in overall length to accommodate different sizes for the remaining components utilized in the roof edging system 10. However, regardless of the size of the cleat 46, the extension cleat 46 includes a locking tab 48 at one end and securing end 50 and apertures 52 at the opposite end such that the extension cleat 46 can be engaged with the anchor bar 22 and fixed to the building 12 in the manner described above. Also, similarly to the previous discussion regarding the anchor bar 22, the extension cleat 46 can be shaped to have forms complimentary to the shape of the walls 14 and the anchor bar 22, such as the right angle shape for the anchor bar miter 44 shown in FIG. 2.

To cover the anchor bar 22 and extension cleat 46 after they are secured to the building 12 and provide an aesthetically pleasing appearance to the system 10, the edging system 10 also includes a cover plate 60. The cover plate 60 is a generally elongate member that is generally L-shaped in cross section, including a narrow elongate section 62 joined at one end to a wide elongate section 64. The narrow section 62 includes an upper locking tab 66 disposed opposite the wide section 64 that extends the length of the narrow section 62 and is dimensioned to engage the groove 30 disposed along the engagement portion 24 of the anchor bar 22. Opposite the narrow section 62, the wide section 64 also includes a lower engagement flange 68 that is adapted to be positioned around the securing end 50 of the extension cleat 46. The narrow section 62 and wide section 64 are integrally formed with one another from a piece of a suitable generally rigid material, such as a metal, that has a thickness generally from about 0.75 mm to about 2.50 mm, and preferably between about 1.10 mm and about 1.80 mm. The cover plates 60 are shaped to conform to the shapes of the anchor bar 22 and extension cleat 46, such as by forming an exterior cover plate miter 70 shown in FIG. 2. Also, to enhance the appearance of the system 10, the cover plate 60 can be painted, or have other decorative material (not shown) placed on the wide section 64 opposite the anchor bar 22 and anchor cleat 46.

The length of the wide section 64 of the cover plate 60 can vary as necessary to provide the appropriate coverage for the edging system 10 on the building 12, which most times depends on the size of the building 12 and the amount of coverage desired from the system 10. When the wide section 64 of the cover plate 60 is lengthened, the edging system 10 can accommodate this length by utilizing an extension cleat 46 having a length capable of increasing the overall length of the anchor bar 22 and extension cleat 46 to securely engage the cover plate 60 and provide the pleasing aesthetic appearance for the building 12. In a preferred embodiment, the system 10 includes cover plates 60 and extension cleats 46 having the appropriate size for the cover plates 60, but the extension cleats 46 may also be formed into the desired configuration on the jobsite as well.

Figure 5:
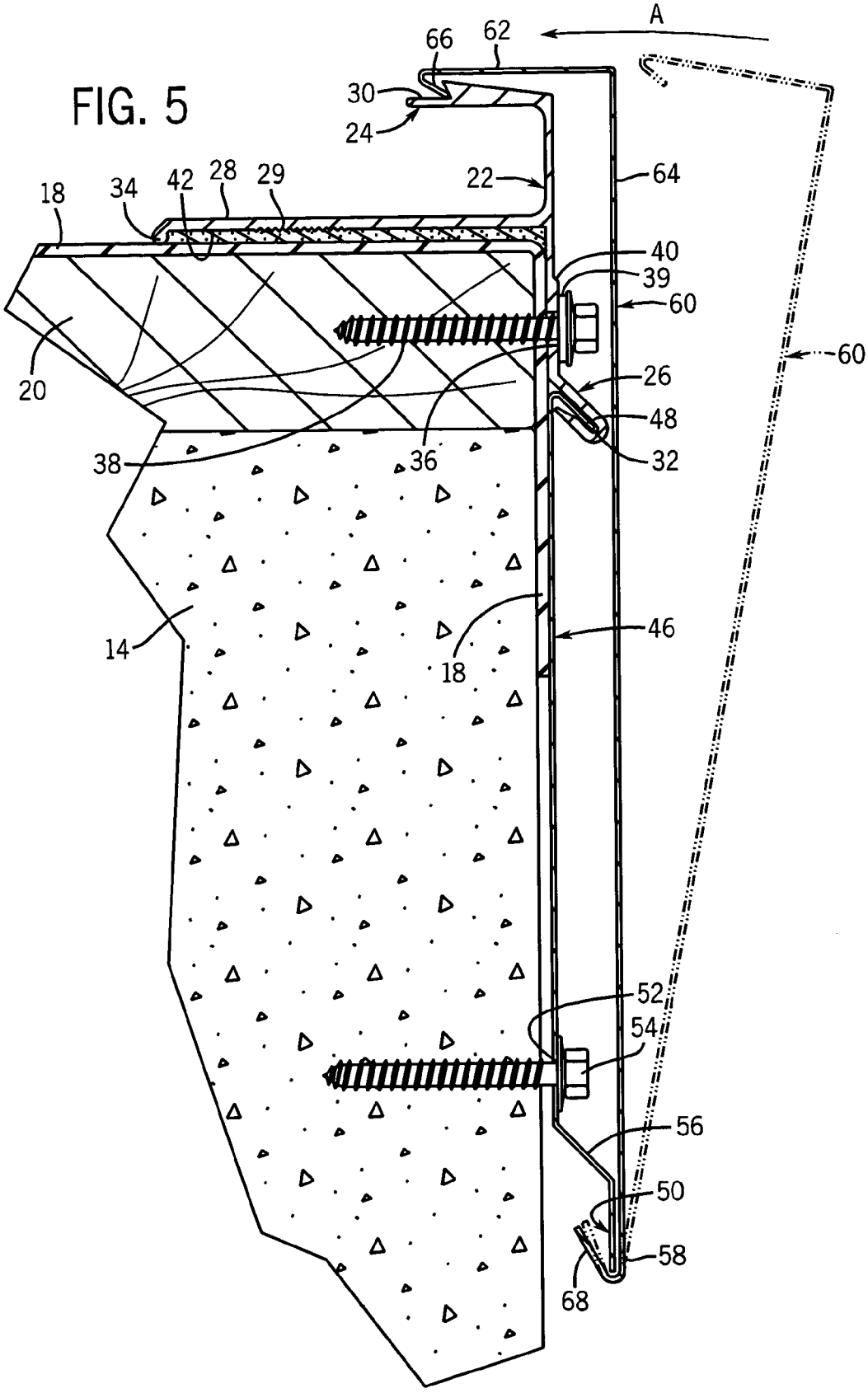
FIG. 5 is a cross-sectional view along line 5-5 of FIG. 1.

In order to secure the cover plate 60 to the anchor bar 22 and extension cleat 46, initially the lower engagement flange 68 is positioned around the securing end 50 of the extension cleat 46. Then, as shown in FIG. 5, the cover plate 60 is pivoted in the direction illustrated by arrow A to engage the upper locking tab 66 on the narrow section 62 with the groove 30 on the engagement portion 24 of the anchor bar 22.

Figure 4:
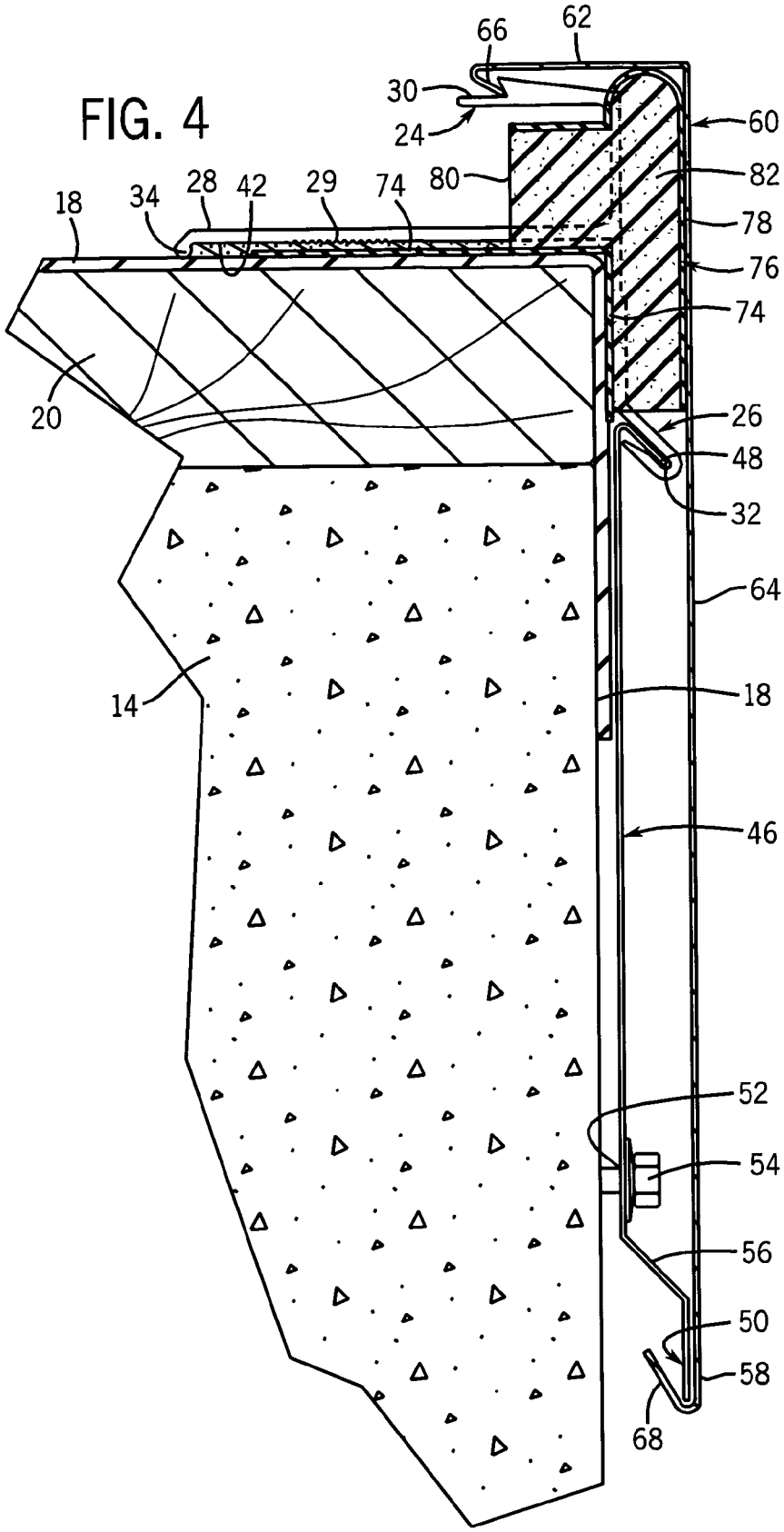
FIG. 4 is a cross-sectional view along line 4-4 of FIG. 1.

Referring now to FIGS. 2, 3 and 4, in order to allow for gaps between adjacent parts of the system 10 and to adjust the overall length of the system to fit a particular wall 14 on a building 12, the system 10 also includes spacers 72 positioned between adjacent anchor bars 22. Each of the spacers 72 includes a base 74 having a generally L-shaped cross section and formed of a flexible, waterproof material, such as a flexible rubber. The base 74 is attached to a generally L-shaped compressible member 76 that includes a vertical portion 78 positioned between the adjacent anchor bars 22, and a horizontal portion 80 that extends inwardly from the vertical portion 78 over the nailer 20 between the sealing flanges 28 on the adjacent anchor bars 22. In a preferred embodiment, the compressible member 76 is integrally formed with the base 74, and is formed to be hollow such that the compressible member 76 can be filled with a foam material 82 that enables the compressible member 76 to be more easily compressed during the installation of the anchor bars 22 to ensure a waterproof seal between the bars 22. The base 74 is positioned beneath each of the anchor bars 22 disposed on either side of the spacer 72 such that the base 74, when compressed against the roofing membrane 18 by the attachment of the anchor bars 22 to the building 12, also assists in providing a watertight seal between the anchor bars 22 and the building 12.

Also, in order to accommodate for the gaps between the anchor bars 22 formed by the spacers 72 and/or other gaps present between adjacent cover plates 60, the system 10 also includes a number of splice plates 84. The splice plates 84 are generally L-shaped in cross-section and formed of a material similar to the cover plate 60, and include a narrow horizontal section 86 and a wide vertical section 88. The dimensions of the narrow section 86 and wide section 88 are slightly less than the narrow section 62 and wide section 64 of the cover plate 60 such that the splice plate 84 can be inserted beneath adjacent cover plates 60 to cover the gaps formed by the spacers 72 and/or between adjacent cover plates 60. The narrow section 86 of each splice plate 84 also includes a protrusion 90 extending upwardly from the narrow section 86 that serves as a stop for the cover plates 60 positioned on either side of the splice plate 84. When the narrow section 62 on each of the adjacent cover plates 60 contacts the protrusion 90, the cover plates 60 are properly positioned on either side of the splice plates 84.

Figure 6:
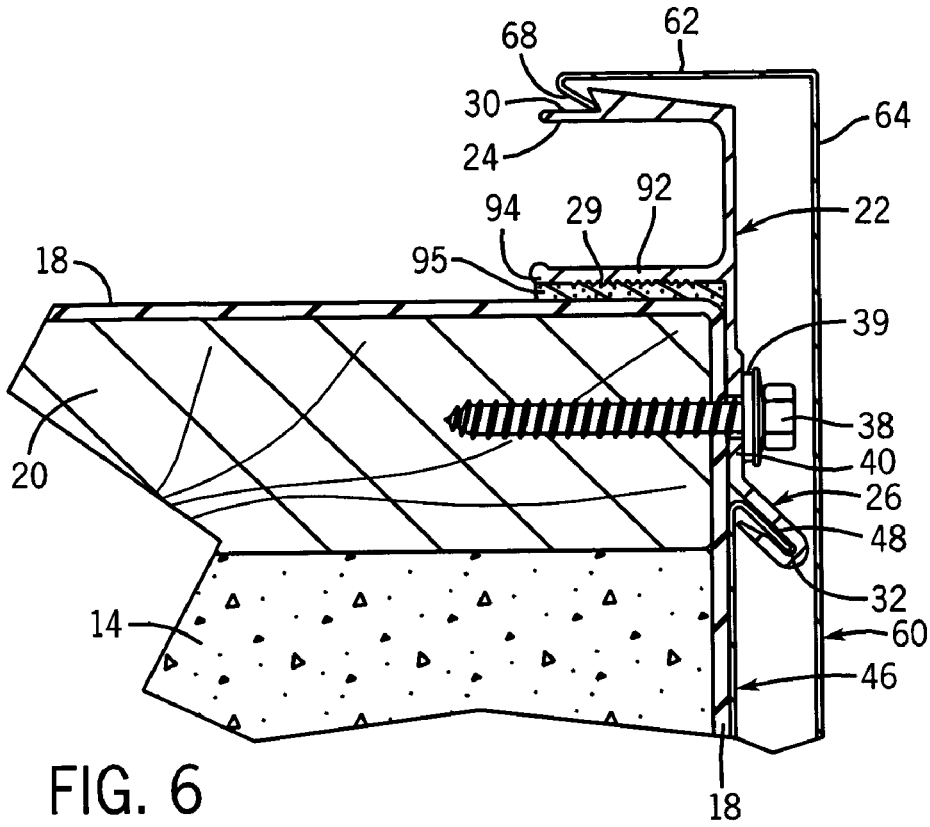
FIG. 6 is a cross-sectional view of a second embodiment of the roof edging assembly of the present invention.

Referring now to FIG. 6, a second embodiment of the edging system 10 of the present invention for use with standard flat roof constructions is illustrated. In this embodiment, the anchor bar 22 includes a sealing flange 92 that has a length approximately equal to the length of the engagement portion 24. The sealing flange 92 includes a bead 94 opposite the anchor bar 22 that protrudes upwardly from the sealing flange 92, allowing a non-curing sealant 95 positioned beneath the flange 92 to be exposed. The non-curing sealant 95 can be any suitable sealant. In this embodiment, the extension cleat 46 and cover plate 60 are secured to the anchor bar 22 in the same manner as the previous embodiment.

Figure 7:
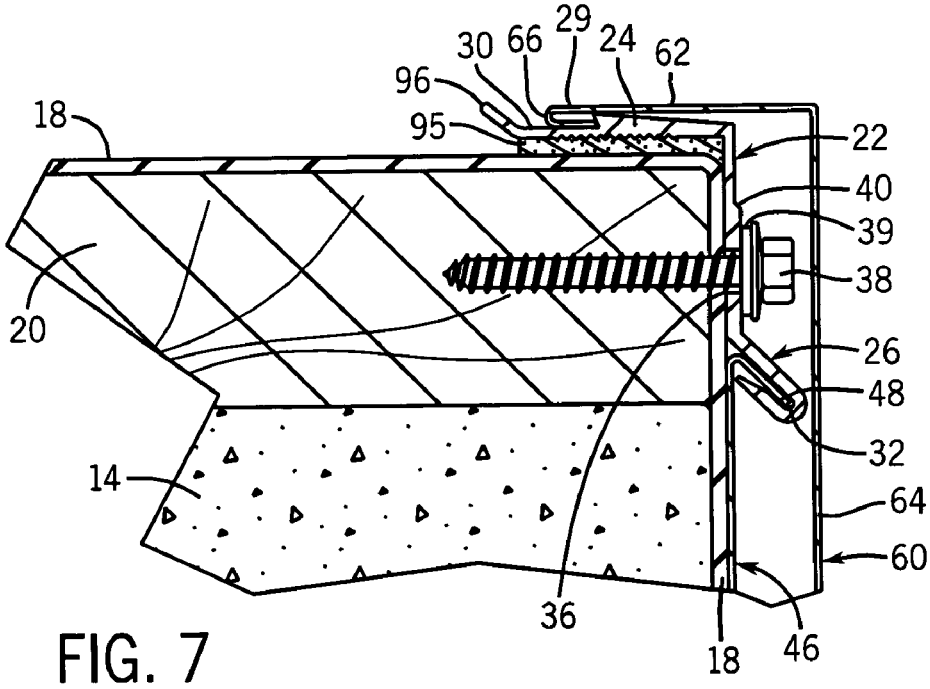
FIG. 7 is a cross-sectional view of a third embodiment of the roof edging assembly of the present invention.

A third embodiment of the edging system 10 of the present invention is illustrated in FIG. 7. In this embodiment, the anchor bar 22 has the sealing flange is essentially combined with the cover engagement portion 24. Thus, in this embodiment, there is only one rearwardly extending flange on the anchor bar 22 which serves to both seal the membrane to the upper surface of the roof combined with a means for attaching cover plate. The locking flange 26 is similarly positioned opposite the engagement portion 24. The engagement portion 24 in this embodiment includes an outwardly extending arm 96, which functions similarly to the bead 94 in the second embodiment to allow a non-curing sealant 95 to be exposed beneath the engagement portion. This third embodiment of the edging system 10 is useful in low profile applications where it is desired to closely conform the level of the narrow section 62 of the cover plate 60 to the overall height of the walls 14 of the building 12.

Figure 8:
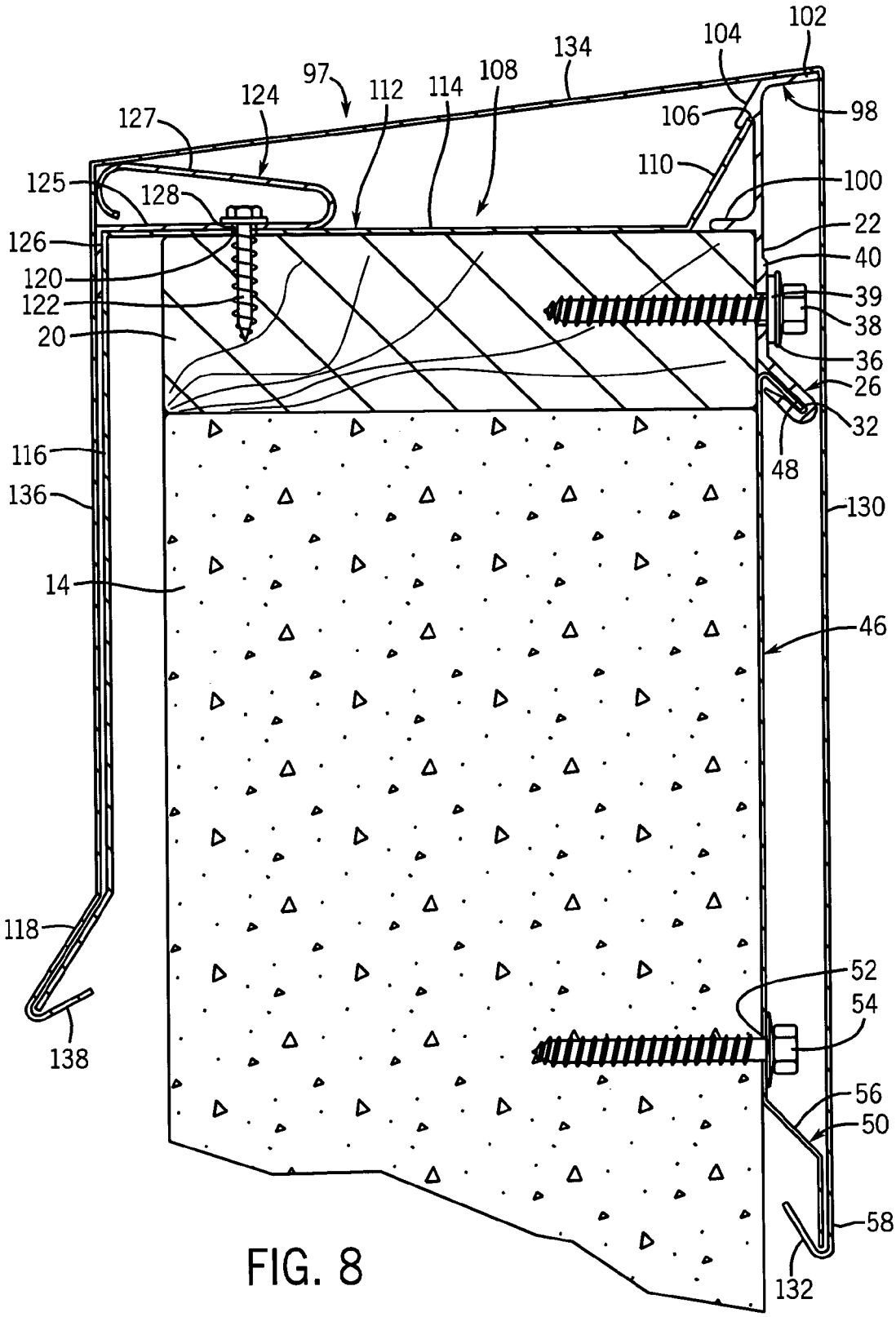
FIG. 8 is a cross-sectional view of a fourth embodiment of the roof edging assembly of the present invention.

A fourth embodiment of the edging system 10 of the present invention is illustrated in FIG. 8. In this embodiment, the anchor bar 22 is adapted for use with a cover plate 97 that forms a coping for a wall 14 of the building 12. In this embodiment, the anchor bar 22 includes a modified engagement portion 98, a shortened sealing flange 100, apertures 36, and locking flange 26. The modified engagement portion 98 is integrally formed with the anchor bar 22 and includes an outwardly extending portion 102 and a downwardly sloping portion 104 disposed on opposite sides of the anchor bar 22 opposite the locking flange 26.

A groove 106 is defined between the downwardly sloping portion 104 and the anchor bar 22, and receives one end of an anchor plate 108. The anchor plate 108 is formed of a generally rigid material, such as a metal, and includes an upwardly extending portion 110 at one end which is received within the groove 106. Opposite the groove 106, the portion 110 is connected with an L-shaped central portion 112 having a horizontal portion 114 positionable on the wooden nailer 20, and a vertical portion 116 extending downwardly from the nailer along the wall 14 opposite the extension cleat 46. The vertical portion 116 includes an outwardly extending portion 118 opposite the upwardly extending portion 110. The anchor plate 108 also includes a number of apertures 120 spaced along the length of the horizontal portion 114 and spaced from the upwardly extending portion 110. The apertures 120 are adapted to receive fasteners 122 capable of securing the anchor plate 108 to the nailer 20.

This particular embodiment of the edging system 10 also includes a spring clip 124 positioned on the horizontal portion 114 adjacent the vertical portion 116. The clip 124 includes a base 125 having a perpendicular aligning flange 126 at one end, and a biased, upwardly extending arm 127 at the opposite end. The flange 126 positions the clip 124 on the horizontal portion 114 of the anchor plate 108 such that an aperture 128 in the base 125 is aligned with the apertures 120 in the anchor plate 108. One of the fasteners 122 is then inserted through the aperture 128 and the aperture 120 to secure the spring clip 124 to the anchor plate 108 and to the wooden nailer 20.

Once the anchor bar 22, extension cleat 46, anchor plate 108, and spring clip 124 are secured to the wall 14, the cover plate or coping 97 is secured around the wall 14 over these elements. The cover plate 97 is generally U-shaped, including a front portion 130 having an engagement flange 132 at one end, an integral center portion 134, opposite the flange 132, and a rear portion 136 secured to the central portion 134 opposite the front portion 130 and having an angled securement member 138 opposite the central portion 134. The cover plate 97 is secured about the wall 14 by initially positioning the central portion 134 over the anchor bar 22 and spring clip 124 and then engaging the engagement member 132 with the securing end 50 of the extension cleat 46. Then the angled securement portion 138 of the rear portion 136 is deflected and engaged with the outwardly extending portion 118 of the anchor plate 108 which pulls the central portion 134 of the cover plate 128 into engagement with the spring clip 124 and outwardly extending portion 102 of the engagement portion 98 of the anchor bar 22.

While the preferred embodiments of the roof edging system 10 have been discussed above, other alternative embodiments for the system 10 and for the various components of the system 10 are also contemplated by this disclosure. For example, each of the components of the various embodiments of the system 10 can be made of a hard plastic instead of a metal to reduce the cost of the system 10. Further, the components of the system 10 can be formed in any conventional manner, such as by casting, molding or extruding the material into the form of the components. Also, while the various components of the system 10 as illustrated as being secured to the building 12 by mechanical fasteners, other securing means can be used, such as industrial adhesives.

Figure 9:
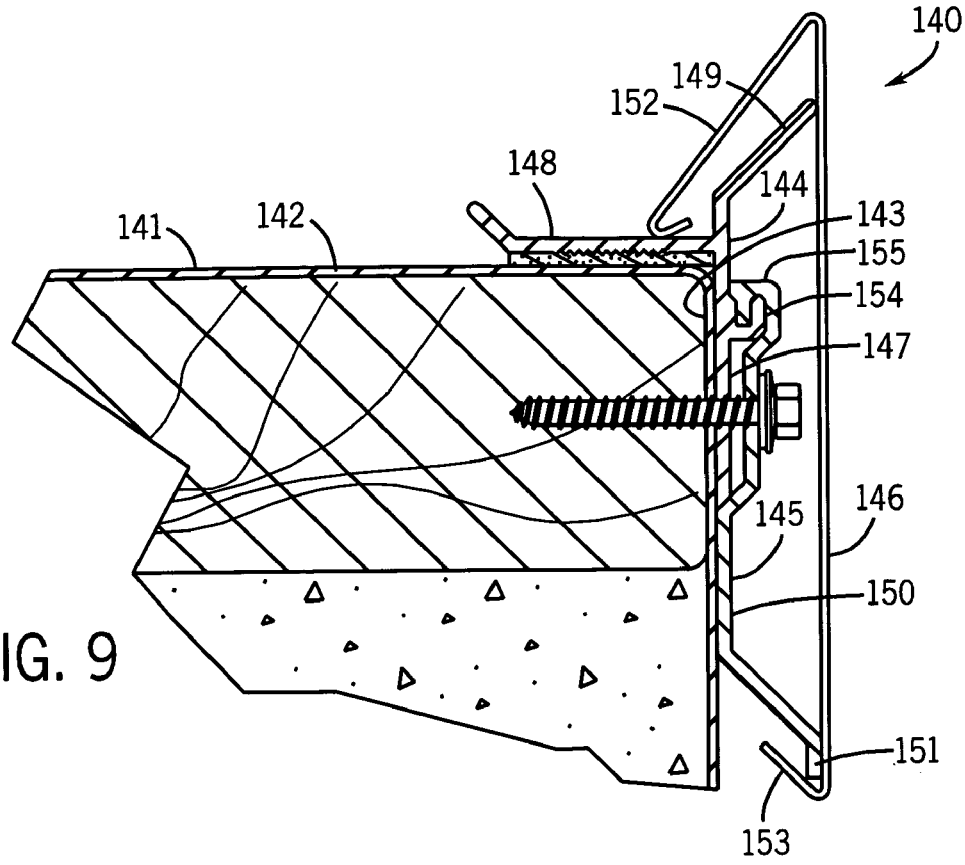
FIG. 9 is a cross-sectional view of a fifth embodiment of the roof edging assembly of the present invention and illustrating an alternative means for attaching the extension cleat to the anchor bar
Figure 10:
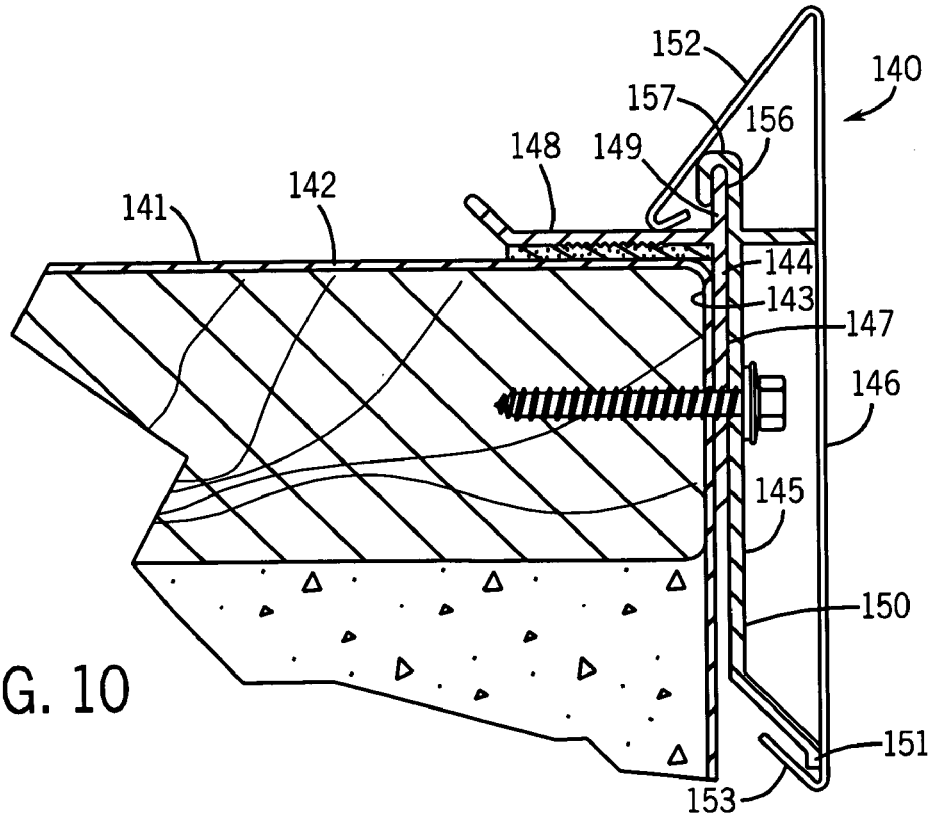
FIG. 10 is a cross-sectional view of a sixth embodiment of the roof edging assembly of the present invention and illustrating a further alternative means for attaching the extension cleat to the anchor bar.
Figure 11:
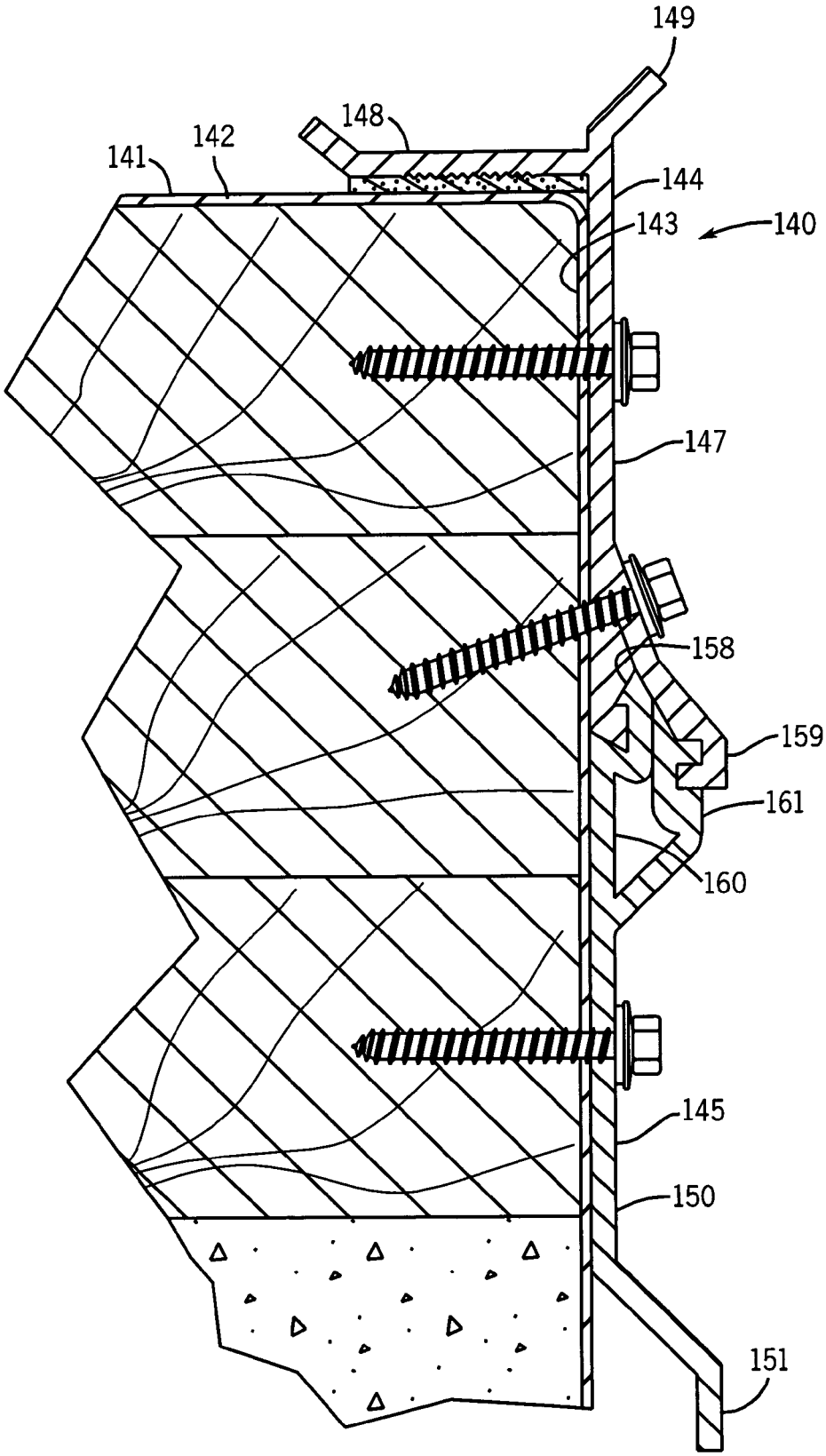
FIG. 11 is a cross-sectional view of a seventh embodiment of the roof edging assembly of the present invention and illustrating an additional alternative means for attaching the extension cleat to the anchor bar.

Several alternative means for attaching the extension cleat to the anchor bar are possible and are contemplated to be within the scope of the invention. Referring to FIGS. 9, 10 and 11, a roof edge assembly 140 is provided for sealing a waterproof membrane 141 onto a roof of a building and providing an aesthetically pleasing appearance to the periphery of a building roof. The roof has a generally flat upper surface 142 and an edge 143 defining a generally vertical surface. The rubber membrane 141 is supported by the upper surface 142 of the roof and a portion of the membrane extends downwardly adjacent the vertical surface of the edge 143 of the roof.

The roof edge assembly 140 essentially comprises an anchor bar 144 attached to the edge of the roof, an extension cleat 145 extending downwardly from the anchor bar, and a cover plate 146. The anchor bar 144 is adapted to be secured to the edge of the roof to clamp the rubber membrane 141 against the upper surface 142 of the roof and against the vertical surface of the edge 143 of the roof. The anchor bar 144 includes a generally planar vertical portion 147 adapted to engage a portion of the rubber membrane to secure it against the vertical surface of the edge 143 of the roof. The generally planar vertical portion 147 of the anchor bar 144 is position in adjacent facing relation to the vertical surface of the edge of the roof. The generally planar vertical portion 147 of the anchor bar has a generally planar rearward surface adapted to be positioned in facing relation with respect to the vertical surface of the edge of the roof to secure the membrane against that vertical surface. The anchor bar further includes a rearwardly extending portion 148 that is integrally and rigidly connected to the planar vertical portion 147. The rearwardly extending portion 148 of the anchor bar 144 includes a lower surface adapted to engage a portion of the rubber membrane supported by the upper surface 142 of the roof to hold the rubber membrane down against the upper surface of the roof. The anchor bar 144 further includes an upper cover plate attachment flange 149 and a means for attaching the extension cleat 145.

The extension cleat 145 includes a generally planar vertical portion 150 adapted to secure it against the vertical surface of the edge of the roof. The generally planar vertical portion 150 of the anchor cleat is positioned in adjacent facing relation to the vertical surface of the edge of the roof and downwardly from the anchor bar 144. The generally planar vertical portion 150 of the extension cleat 145 similarly has a generally planar rearward surface adapted to be positioned in facing relation with respect to the vertical surface of the edge of the roof downwardly from the anchor bar. The extension cleat 145 further includes a lower cover plate attachment flange 151 and a portion that cooperates with the means for attachment on the anchor bar 144.

The cover plate 146 includes a first engagement flange 152 at one end of the cover plate which is engageable with the upper cover plate attachment flange 149 on the anchor bar 144. The cover plate 146 further includes a second engagement flange 153 at the opposite end which is engageable with the lower cover plate attachment flange 151 on the extension cleat 145.

As explained above with respect to the FIGS. 1-8, one possible means for attaching the extension cleat to the anchor bar may be comprised of a generally C-shaped flange or channel on the anchor bar, and the extension cleat includes a lip that mates with the C-shaped flange. The lip on the extension cleat may be further comprised of a generally C-shaped flange that mates with the first C-shaped flange on the anchor bar. In that configuration, the first C-shaped flange on the anchor bar is formed by a first flange portion which extends outwardly from the generally planar vertical portion of the anchor bar and a second upwardly turned portion. The second C-shaped flange on the extension cleat has a downwardly turned portion which fits within upwardly turned portion of the first C-shaped flange on the anchor bar.

Referring to FIG. 9, the means for attaching the extension cleat 145 to the anchor bar 144 may alternatively be comprised of an upwardly extending edge 154 on the anchor bar, and a downwardly turned C-shaped flange 155 on the extension cleat that fits over the upwardly extending edge on the anchor bar. Referring to FIG. 10, the means for attaching the extension cleat 145 to the anchor bar 144 may alternatively be comprised of an upwardly extending edge 156 at the top of the anchor bar, and the top of the extension cleat including a downwardly turned C-shaped end 157 that fits over the top edge 156 of the anchor bar. Referring to FIG. 11, the attachment means may alternatively be comprised of pair of downwardly extending Y-shaped arms 158 and 159 forming a receiving channel on the anchor bar 144, and the extension cleat 145 including upwardly extending ridges 160 and 161 that mate with the downwardly extending arms on the anchor bar.

Various alternative embodiments of the invention, including alternative means for attaching extension cleat to the anchor bar, are contemplated as being within the scope of the following claims which particularly point out and distinctly claim the subject matter regarded as the invention.

We claim:

1. An assembly for sealing and providing an aesthetically pleasing appearance to the periphery of a roof, the assembly comprising:

an anchor bar having a vertical portion, the vertical portion of the anchor bar being secured parallel to a vertical portion of a building over a roof membrane, said roof membrane disposed between the vertical portion of the anchor bar and building, a sealing flange extending from said anchor bar, a locking flange being formed on one end of said anchor bar;

an anchor cleat being retained adjacent to a vertical portion of the building, a locking tab being formed on one end of said anchor cleat, said locking tab being retained by said locking flange, said anchor cleat being engaged with said anchor bar, said anchor cleat not extending above a top of said anchor bar, a substantial portion of a length of said anchor cleat extending below said anchor bar; and a cover plate being retained adjacent to said anchor cleat and said anchor bar.

2. An assembly for sealing and providing an aesthetically pleasing appearance to the periphery of a roof of claim 1, wherein:

a first engagement flange being formed on one end of said cover plate, said first engagement flange being engaged with said anchor cleat.

3. An assembly for sealing and providing an aesthetically pleasing appearance to the periphery of a roof of claim 2, wherein:

an engagement portion being formed on the other end of said anchor bar, a second engagement flange being formed on the other end of said cover plate, said second engagement flange being retained by said engagement portion.

4. An assembly for sealing and providing an aesthetically pleasing appearance to the periphery of a roof of claim 1, wherein:

one end of said anchor cleat being offset from said anchor cleat to provide clearance for said engagement flange.

5. An assembly for sealing and providing an aesthetically pleasing appearance to the periphery of a roof, the assembly comprising:

an anchor bar having a vertical portion, the vertical portion of the anchor bar being secured parallel to a vertical portion of a building over a roof membrane, said roof membrane disposed between the vertical portion of the anchor bar and building, a sealing flange extending from said anchor bar, a locking flange being formed on substantially one end of said anchor bar;

an anchor cleat being retained adjacent to a vertical portion of the building, a locking tab being formed on substantially one end of said anchor cleat, said locking tab being retained by said locking flange, said anchor cleat not extending above a top of said anchor bar, a substantial portion of a length of said anchor cleat extending below said anchor bar; and a cover plate being retained adjacent to said anchor cleat and said anchor bar.

6. An assembly for sealing and providing an aesthetically pleasing appearance to the periphery of a roof of claim 5, wherein:

a first engagement flange being formed on one end of said cover plate, said first engagement flange being engaged with said anchor cleat.

7. An assembly for sealing and providing an aesthetically pleasing appearance to the periphery of a roof of claim 6, wherein:

an engagement portion being formed on the other end of said anchor bar, a second engagement flange being formed on the other end of said cover plate, said second engagement flange being retained by said engagement portion.

8. An assembly for sealing and providing an aesthetically pleasing appearance to the periphery of a roof of claim 6, wherein:

one end of said anchor cleat being offset from said anchor cleat to provide clearance for said engagement flange.

9. An assembly for sealing and providing an aesthetically pleasing appearance to the periphery of a roof, the assembly comprising:

an anchor bar having a vertical portion, the vertical portion of the anchor bar being secured parallel to a vertical portion of a building over a roof membrane, said roof membrane disposed between the vertical portion of the anchor bar and building, a sealing flange extending from said anchor bar, a locking flange being formed on said anchor bar;

an anchor cleat being retained adjacent to a vertical portion of the building, a locking tab being formed on said anchor cleat, said locking tab being retained by said locking flange, said anchor cleat not extending above a top of said anchor bar, a substantial portion of a length of said anchor cleat extending below said anchor bar; and a cover plate being retained adjacent to said anchor cleat and said anchor bar.

10. An assembly for sealing and providing an aesthetically pleasing appearance to the periphery of a roof of claim 9, wherein:

a first engagement flange being formed on one end of said cover plate, said first engagement flange being engaged with said anchor cleat.

11. An assembly for sealing and providing an aesthetically pleasing appearance to the periphery of a roof of claim 10, wherein:

an engagement portion being formed on said anchor bar, a second engagement flange being formed on the other end of said cover plate, said second engagement flange being retained by said engagement portion.

12. An assembly for sealing and providing an aesthetically pleasing appearance to the periphery of a roof of claim 9, wherein:

one end of said anchor cleat being offset from said anchor cleat to provide clearance for said engagement flange.

* * * * *